US008864124B2

(12) United States Patent
Yamamoto

(10) Patent No.: US 8,864,124 B2
(45) Date of Patent: Oct. 21, 2014

(54) SHEET CONVEYING APPARATUS AND IMAGE FORMING APPARATUS INCLUDING THE SAME

(71) Applicant: Kyocera Document Solutions Inc., Osaka (JP)

(72) Inventor: Koju Yamamoto, Osaka (JP)

(73) Assignee: Kyocera Document Solutions Inc., Osaka (JP)

( * ) Notice: Subject to any disclaimer, the term of this patent is extended or adjusted under 35 U.S.C. 154(b) by 0 days.

(21) Appl. No.: 13/953,324

(22) Filed: Jul. 29, 2013

(65) Prior Publication Data

US 2014/0035219 A1 Feb. 6, 2014

(30) Foreign Application Priority Data

Aug. 6, 2012 (JP) ..... 2012-173606

(51) Int. Cl.

| | |
|---|---|
| ***B65H 3/44*** | (2006.01) |
| ***B65H 5/26*** | (2006.01) |
| ***B65H 5/00*** | (2006.01) |
| ***B65H 5/36*** | (2006.01) |

(52) U.S. Cl.

CPC .. *B65H 5/36* (2013.01); *B65H 3/44* (2013.01); *B65H 2402/441* (2013.01)

USPC ..... 271/9.09; 271/264; 271/9.13

(58) Field of Classification Search

CPC ..... B65H 2404/74; B65H 2404/741; B65H 3/44; B65H 5/36; B65H 2404/7414; B65H 2402/441

USPC ..... 271/9.09, 9.13, 264

See application file for complete search history.

(56) References Cited

U.S. PATENT DOCUMENTS

| | | | | |
|---|---|---|---|---|
| 5,201,873 | A | 4/1993 | Kikuchi et al. | |
| 6,527,267 | B1 * | 3/2003 | Kuwata et al. | 271/9.13 |
| 7,410,166 | B2 * | 8/2008 | Mizubata et al. | 271/264 |
| 7,784,786 | B2 * | 8/2010 | Tashiro et al. | 271/264 |
| 8,177,216 | B2 * | 5/2012 | Watase et al. | 271/9.13 |
| 8,267,400 | B2 * | 9/2012 | Nishikata et al. | 271/264 |
| 8,540,242 | B2 * | 9/2013 | Ise | 271/265.04 |
| 8,590,890 | B2 * | 11/2013 | Haruyama | 271/264 |
| 2002/0060389 | A1 * | 5/2002 | Sugimura | 271/9.11 |
| 2009/0166966 | A1 * | 7/2009 | Nishikata et al. | 271/272 |
| 2010/0301549 | A1 * | 12/2010 | Moriyama | 271/264 |
| 2010/0314827 | A1 * | 12/2010 | Nishii et al. | 271/264 |

FOREIGN PATENT DOCUMENTS

| | | | | |
|---|---|---|---|---|
| JP | 04-064540 A | | 2/1992 | |
| JP | 06001488 A | * | 1/1994 | B65H 5/36 |

* cited by examiner

*Primary Examiner* — Patrick Cicchino

(74) *Attorney, Agent, or Firm* — Knobbe, Martens, Olson & Bear LLP

(57) ABSTRACT

A sheet conveying apparatus includes a casing, a first conveying path, a second conveying path, a joining conveyance path, and a guide member. The joining conveyance path is connected to a junction portion of the first conveying path and the second conveying path, and extends downward in a sheet conveying direction. The guide member is disposed in the junction portion of the first conveying path and the second conveying path, and shifted to a position between a first position to guide the first sheet from the first conveying path to the joining conveyance path and a second position to guide the second sheet from the second conveying path to the joining conveyance path. The guide member includes a supporting point portion disposed at a central part or around thereof in a lengthwise direction, so as to change in position by pivoting around the supporting point portion.

9 Claims, 9 Drawing Sheets

SHEET CONVEYING APPARATUS AND IMAGE FORMING APPARATUS INCLUDING THE SAME

INCORPORATION BY REFERENCE

This application claims priority to Japanese Patent Application No. 2012-173606 filed on 6, Aug., 2012 the entire contents of which are incorporated by reference herein.

BACKGROUND

The present disclosure relates to a sheet conveying apparatus and an image forming apparatus including the same.

In an image forming apparatus for forming an image on a sheet, a toner image is formed on a photosensitive drum of an image forming section, and the toner image is transferred onto the sheet in a transfer nip portion. The image forming apparatus further includes a fixing section, and the sheet onto which the toner image has been transferred is subjected to a fixing process in the fixing section and then discharged.

The image forming apparatus as described above includes a paper feed device disposed to feed sheets to the transfer nip portion. The paper feed device includes a sheet cassette and a manual feed tray. In addition, a first sheet conveying path extending from the sheet cassette and a second sheet conveying path extending from the manual feed tray are joined in a conveying path joining section before reaching the transfer nip portion. Therefore, in order to selectively communicate any one of the first and second conveying paths with the transfer nip portion, a swingable switching guide member is disposed in the conveying path joining section.

Further, there is an image forming apparatus including an elongated shaped switching guide member, as seen from a cross-section in a direction orthogonal to a sheet conveying direction. In this image forming apparatus, as an upper end side of the switching guide member pivots around a supporting point disposed at a lower end part of the switching guide member, the sheet conveying path is switched.

SUMMARY

As an aspect of the present disclosure, technology for further improving the above-described related art is proposed.

A sheet conveying apparatus in accordance of an aspect of the present disclosure includes a casing, a first conveying path, a second conveying path, a junction portion, a joining conveyance path, and a guide member.

The first conveying path is disposed in the casing to convey a first sheet.

The second conveying path is disposed in the casing to convey a second sheet, and joined with the first conveying path.

The junction portion is a portion in which the first conveying path and the second conveying path are joined.

The joining conveyance path is connected to a junction portion of the first conveying path and the second conveying path, and extends downstream in a sheet conveying direction on the first conveying path and the second conveying path.

The guide member is disposed in the junction portion, and configured to shift a position between a first position to guide the first sheet from the first conveying path to the joining conveyance path and a second position to guide the second sheet from the second conveying path to the joining conveyance path.

In addition, the guide member is formed in an elongated shape as seen from a cross-section orthogonal to a sheet width direction of each sheet, and has a supporting point portion disposed at a central part or a vicinity thereof in a lengthwise direction of the elongated shape, so as to shift the position by pivoting around the supporting point portion.

DETAILED DESCRIPTION

Figure 1:
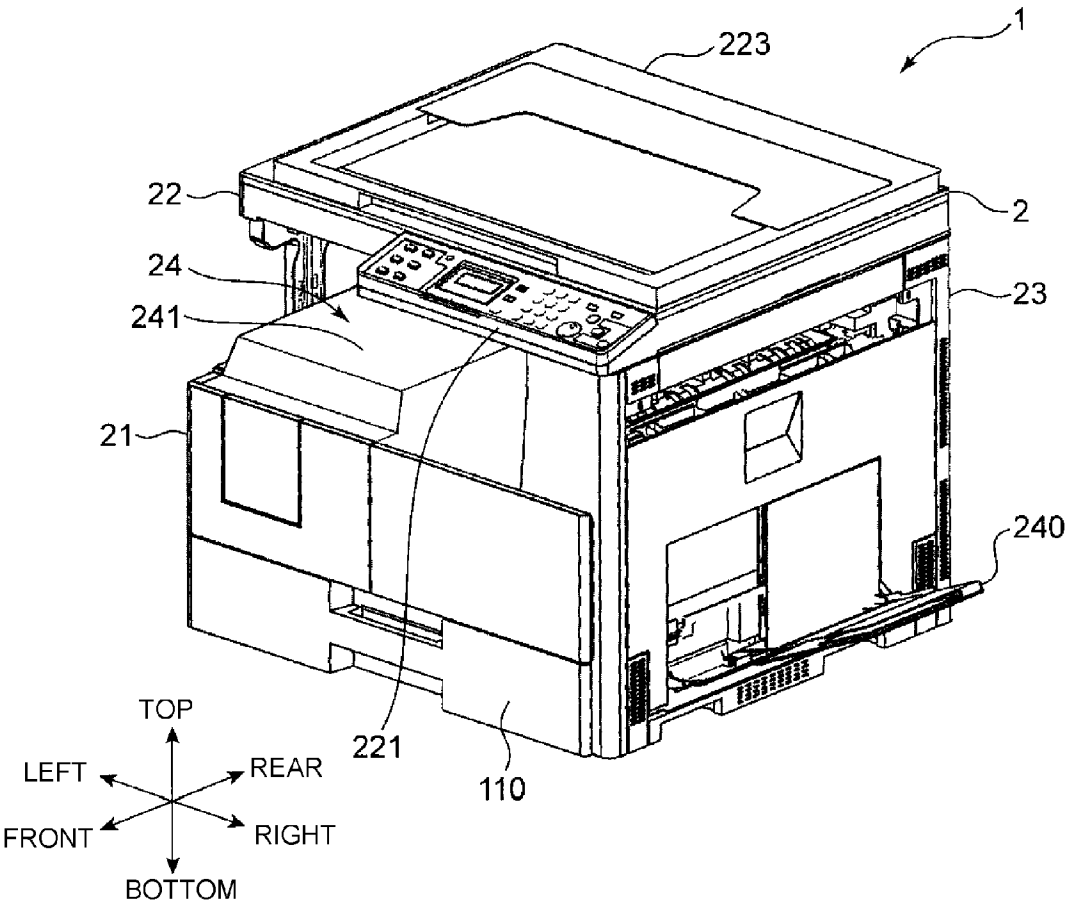
FIG. 1 is a perspective view of an image forming apparatus according to an embodiment of the present disclosure.
Figure 2:
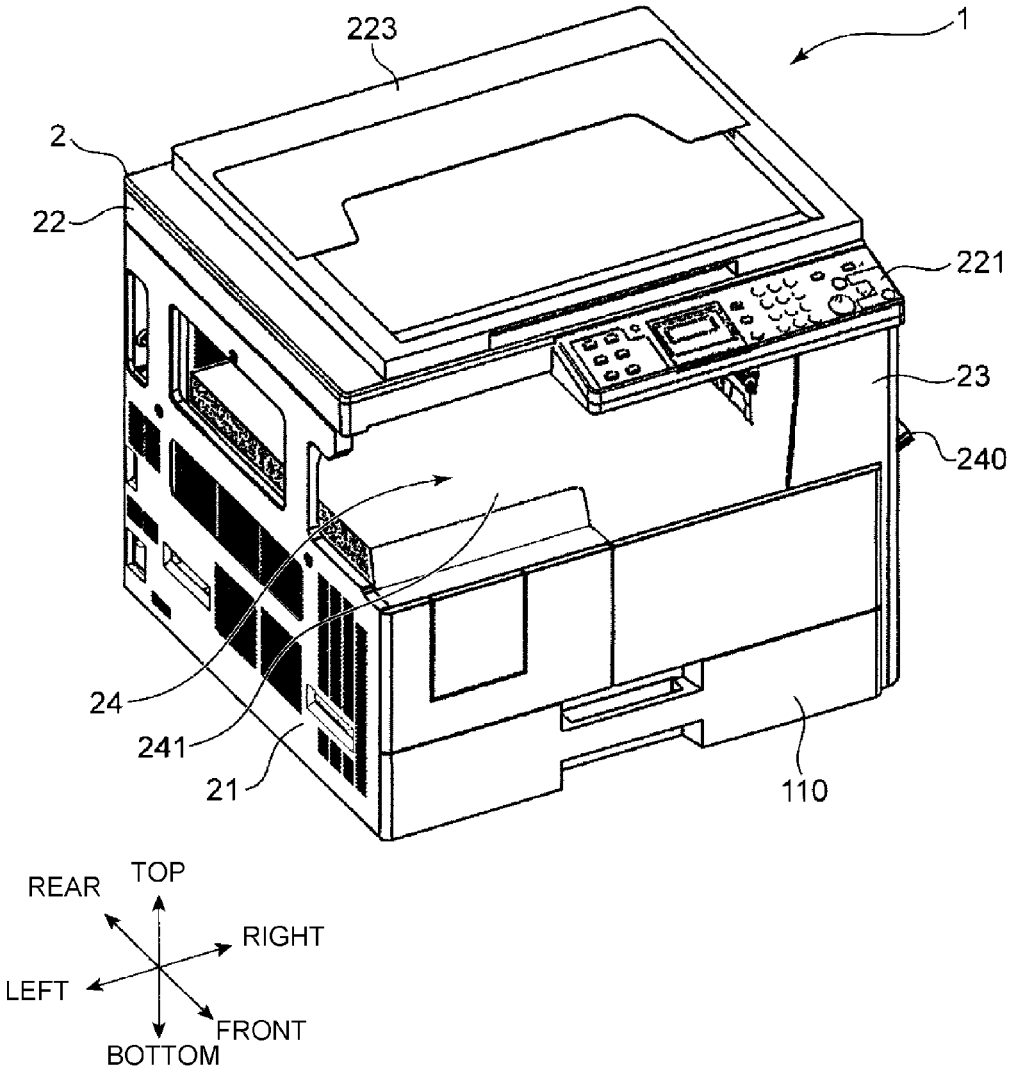
FIG. 2 is a perspective view of the image forming apparatus according to the embodiment of the present disclosure.
Figure 3:
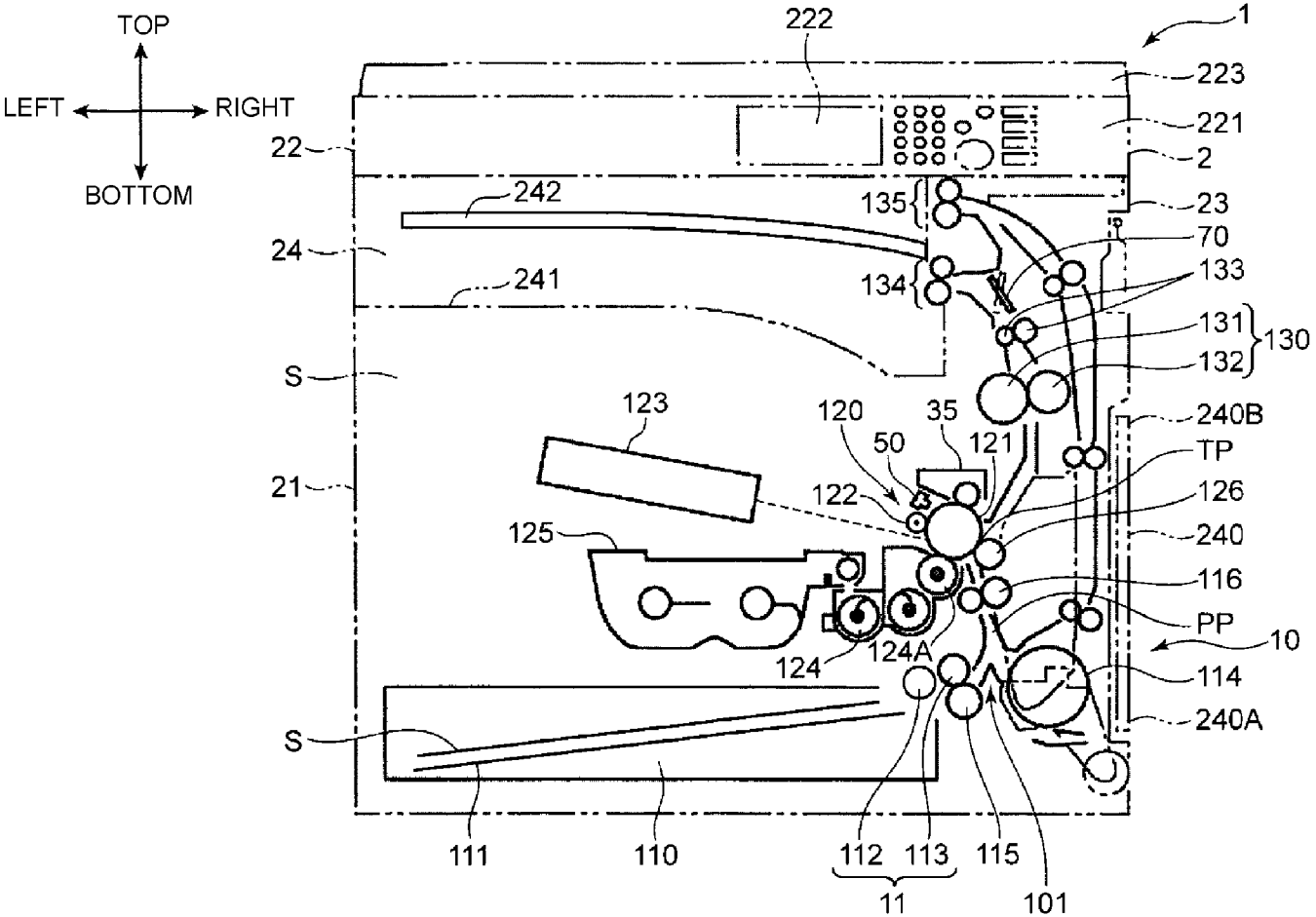
FIG. 3 is an internal cross-sectional view of the image forming apparatus according to the embodiment of the present disclosure.

Hereinafter, an embodiment of the present disclosure will be described with reference to the drawings. FIGS. 1 and 2 are exterior perspective views of an image forming apparatus 1 according to the embodiment of the present disclosure. In addition, FIG. 3 is an internal cross-sectional view of the image forming apparatus 1. The image forming apparatus 1 illustrated in FIGS. 1 to 3 is so called a monochrome multifunction device, however, in other embodiments, the image forming apparatus may be another apparatus for forming a toner image, an ink image, etc. on a sheet in a color multifunction device, a color printer, a facsimile apparatus, or the like. Furthermore, terms indicating directions such as "up," "down," "front," "rear," "left," or "right" that are used in the description below are simply aimed to clarify the description, and do not limit the principle of the image forming apparatus in the least. Further, in the description below, the term "sheet" means copying paper, coated paper, an OHP sheet, thick paper, a postcard, tracing paper or other sheet materials subjected to an image forming process, or sheet materials subjected to other processes than the image forming process.

The image forming apparatus 1 includes a substantially rectangular main casing 2. The main casing 2 includes a substantially rectangular lower casing 21 (a casing), a substantially rectangular upper casing 22 arranged above the lower casing 21, and a connecting casing 23 configured to connect the lower casing 21 and the upper casing 22. The connecting casing 23 extends along a right edge and a back surface edge of the main casing 2. A sheet S subjected to a print process is discharged to a discharge space 24 surrounded by the lower casing 21, the upper casing 22, and the connecting casing 23. In particular, in this embodiment, the sheet S is discharged to a paper ejection section 241 disposed on an upper surface part of the lower casing 21, and to a paper ejection tray 242 (FIG. 3) disposed above the paper ejection section 241.

An operation section 221 disposed in a front direction of the upper casing 22, for example, includes an LCD touch panel 222. The operation section 221 is formed to enable information on image forming processes to be input. A user can input, for example, the number of sheets to be printed, the print intensity, or the like through the LCD touch panel 222. The upper casing 22 mainly includes a device for reading an image from a manuscript, and an electronic circuit for executing overall control of the image forming apparatus 1 housed therein.

A pressing cover 223 arranged on the upper casing 22 is used to press against the manuscript. A rear side of the pressing cover 223 is pivotably attached to the upper casing 22. A front side of the pressing cover 223 can pivot vertically. The user loads the manuscript on the upper casing 22 by pivoting the pressing cover 223 upward. Thereafter, the user operates the operation section 221 to cause the device arranged in the upper casing 22 to read an image from the manuscript.

A manual feed tray 240 is arranged on a right side surface of the lower casing 21. The manual feed tray 240 is configured such that an upper end 240B side thereof can pivot vertically with a lower end 240A thereof (FIG. 3) as a supporting point. When the manual feed tray 240 is pivoted downward and positioned at a position at which the manual feed tray 240 protrudes to a right side of the lower casing 21, the user can load the sheet S on the manual feed tray 240. The sheet S loaded on the manual feed tray 240 (a sheet S2, which is a second sheet) is drawn into the lower casing 21, and then image forming processes are carried out based on instructions input by the user through the operation section 221, and discharged to the discharge space 24. In addition, the lower casing 21 includes an internal space S formed therein to install various devices to be described later (FIG. 3).

The image forming apparatus 1 includes a paper feed device 10, a pair of registration rollers 116, and an image forming section 120. The paper feed device 10 includes a cassette 110 (a sheet loading section), a paper feed section 11, a second paper feed roller 114, and a conveyance junction section 101 (junction portion).

The cassette 110 is configured to house a sheet S (a sheet S1, which is a first sheet). The cassette 110 can be drawn from the lower casing 21 in the front direction (a front direction of a paper surface in FIG. 3). The sheet S housed in the cassette 110 is fed upward in the lower casing 21. Thereafter, image forming processes are carried out on the sheet S in the lower casing 21 based on the instructions input by the user through the operation section 221, and discharged to the discharge space 24. The cassette 110 includes a lift plate 111 configured to support the sheet S. The lift plate 111 descends so as to press a front head edge of the sheet S upward.

The paper feed section 11 includes a pickup roller 112, and a first paper feed roller 113. The paper feed section 11 sends the sheet S in the cassette 110 to a sheet conveying path PP. The sheet conveying path PP is a conveying path arranged so that the sheet from the paper feed section 11 passes through a transfer position TP, which is arranged in the image forming section 120, through the pair of registration rollers 116.

The pickup roller 112 is disposed over the front head edge of the sheet S pressed upward by the lift plate 111. When the pickup roller 112 rotates, the sheet S is sent from the cassette 110 to the first paper feed roller 113.

The first paper feed roller 113 is arranged on a downstream side in a sheet conveying direction of the pickup roller 112. The first paper feed roller 113 sends the sheet S further downstream in the sheet conveying direction. In addition, a counter roller 115 is disposed to face the first paper feed roller 113 below the first paper feed roller 113. A paper feed nip into which the sheet S is sent is formed at a facing portion between the first paper feed roller 113 and the counter roller 115.

A second paper feed roller 114 is arranged on the inside of the lower end 240A of the manual feed tray 240. The second paper feed roller 114 conveys a sheet on the manual feed tray 240 into the lower casing 21. The user can selectively use the sheet S housed in the cassette 110, or the sheet S loaded on the manual feed tray 240.

The conveyance junction section 101 is a portion in which a sheet conveying path extending from the cassette 110 and a sheet conveying path extending from the manual feed tray 240 are joined. The conveyance junction section 101 will be described later in further detail.

The pair of registration rollers 116 defines a position of the sheet in a direction orthogonal to the sheet conveying direction. Thereby, a position of an image to be formed on the sheet S is adjusted. The pair of registration rollers 116 form a nip portion between the rollers. The pair of registration rollers 116 convey the sheet S to the image forming section 120 at such a time that a toner image will be transferred onto the sheet S in the image forming section 120. In addition, the pair of registration rollers 116 have a function of correcting any skewing of the sheet S.

The image forming section 120 includes a photosensitive drum 121, a charging device 122, an exposing device 123, a developing device 124, a toner container 125, a transfer roller 126, a cleaning device 35, a static eliminator 50, and the like.

The photosensitive drum 121 has a substantially cylindrical body shape. The photosensitive drum 121 is configured to have an electrostatic latent image formed on a peripheral surface thereof and carry a toner image based on the electrostatic latent image.

The charging device 122 substantially uniformly electrifies the peripheral surface of the photosensitive drum 121 by applying a predetermined voltage thereto. The exposing device 123 radiates laser light to the peripheral surface of the photosensitive drum 121 electrified by the charging device 122. The laser light is radiated based on image data output from an external device (not illustrated), such as a personal computer, which is connected to the image forming apparatus 1 and capable of communication therewith. As a result, an electrostatic latent image is formed on the peripheral surface of the photosensitive drum 121 corresponding to the image data.

The developing device 124 supplies toner to a peripheral surface of the photosensitive drum 121 with the electrostatic latent image formed thereon. The toner container 125 supplies toner to the developing device 124. The toner container 125 supplies toner to the developing device 124 sequentially or as necessary. If toner is supplied to the photosensitive drum 121 by the developing device 124, the electrostatic latent image formed on the peripheral surface of the photosensitive drum 121 is developed (visualized). As a result, a toner image is formed on the peripheral surface of the photosensitive drum 121. The developing device includes a developing roller 124A configured to carry toner on a peripheral surface thereof. The developing roller 124A is disposed to face the photosensitive drum 121 at a developing position. The developing roller 124A is rotatably driven to supply toner to the photosensitive drum 121.

The transfer roller 126 is arranged to face the peripheral surface of the photosensitive drum 121 at the transfer position TP. In the transfer position TP, the transfer roller 126 is rotationally driven in the same direction as the photosensitive drum 121. The toner image formed on the peripheral surface of the photosensitive drum 121 is transferred onto the sheet S in the transfer position TP.

The cleaning device 35 removes toner remaining on the peripheral surface of the photosensitive drum 121 after the toner image is transferred onto the sheet S. The static eliminator 50 radiates a predetermined static-eliminating light to the photosensitive drum 121 whose peripheral surface has been cleaned by the cleaning device 35. As a result, the photosensitive drum 121 has a uniform potential across the peripheral surface thereof.

After the photosensitive drum 121 is cleaned by the cleaning device 35, the peripheral surface of the photosensitive drum 121 from which static has been eliminated by the static eliminator 50 passes below the charging device 122 again to be uniformly electrified. Thereafter, the above-described forming of the toner image is carried out again.

The image forming apparatus 1 further includes a fixing device 130 configured to fix the toner image onto the sheet S downstream in the conveying direction from the image forming section 120. The fixing device 130 includes a heating roller 131 for melting toner onto the sheet S, and a pressing roller 132 for pressing the sheet S to the heating roller 131. When the sheet S passes between the heating roller 131 and the pressing roller 132, the toner image is fixed to the sheet S.

The image forming apparatus 1 further includes a pair of conveying rollers 133 arranged downstream from the fixing device 130, a switching section 70 arranged downstream from the pair of conveying rollers 133, lower discharge rollers 134, and upper discharge rollers 135. The pair of conveying rollers 133 convey the sheet S subjected to the fixing process by the fixing device 130 downstream in the sheet conveying direction. The switching section 70 has a function of switching the conveying direction of the sheet S downstream in the sheet conveying direction from the pair of conveying rollers 133. The lower discharge rollers 134 are disposed at the left of the switching section 70 to discharge the sheet S conveyed by the pair of conveying rollers 133 to the paper ejection section 241. The upper discharge rollers 135 are disposed above the lower discharge rollers 134 to discharge the sheet S conveyed by the pair of conveying rollers 133 to a paper ejection tray 242 mounted above the paper ejection section 241.

Figure 4:
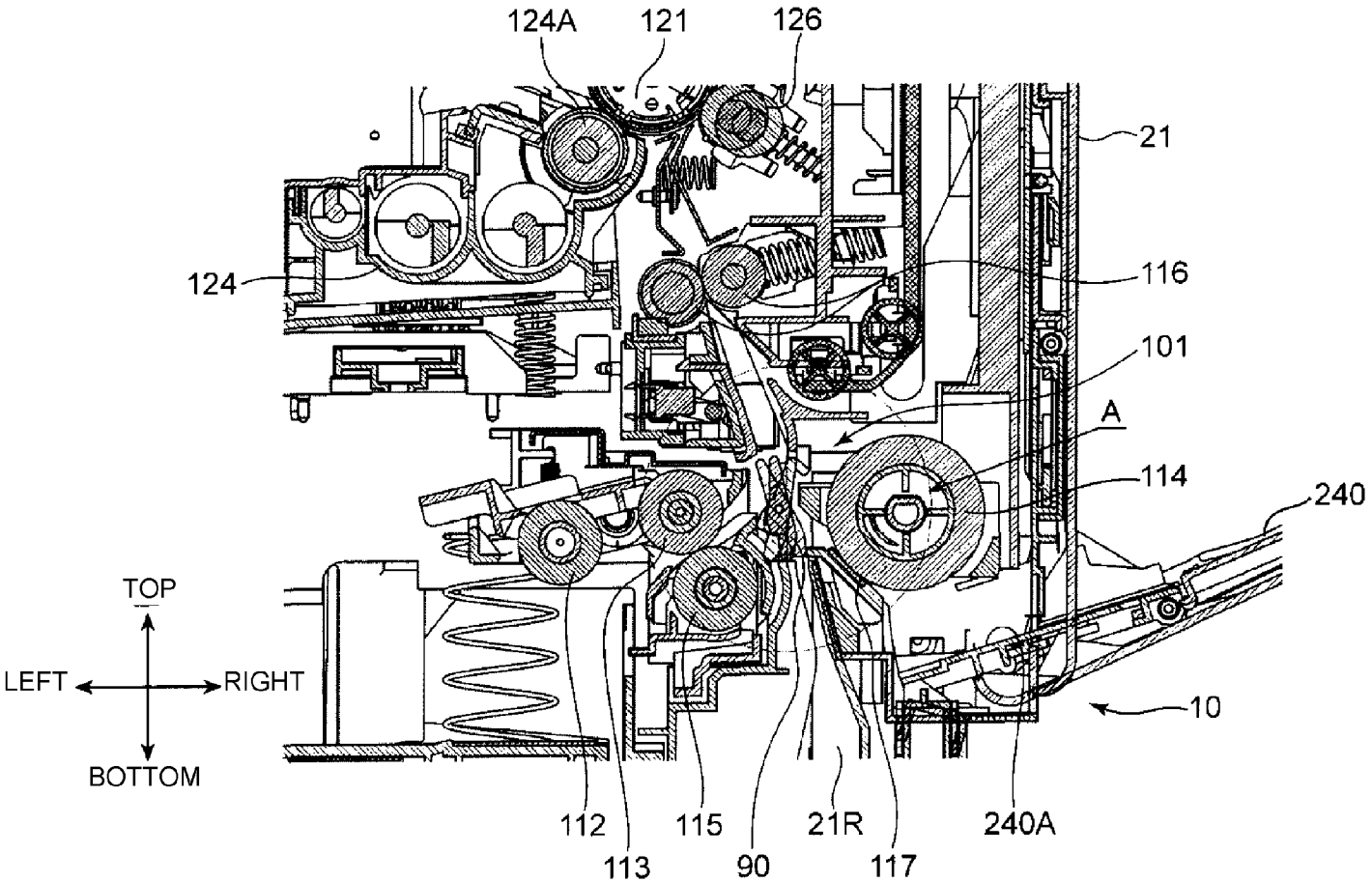
FIG. 4 is an enlarged cross-sectional view of a part of the image forming apparatus according to the embodiment of the present disclosure.
Figure 5:
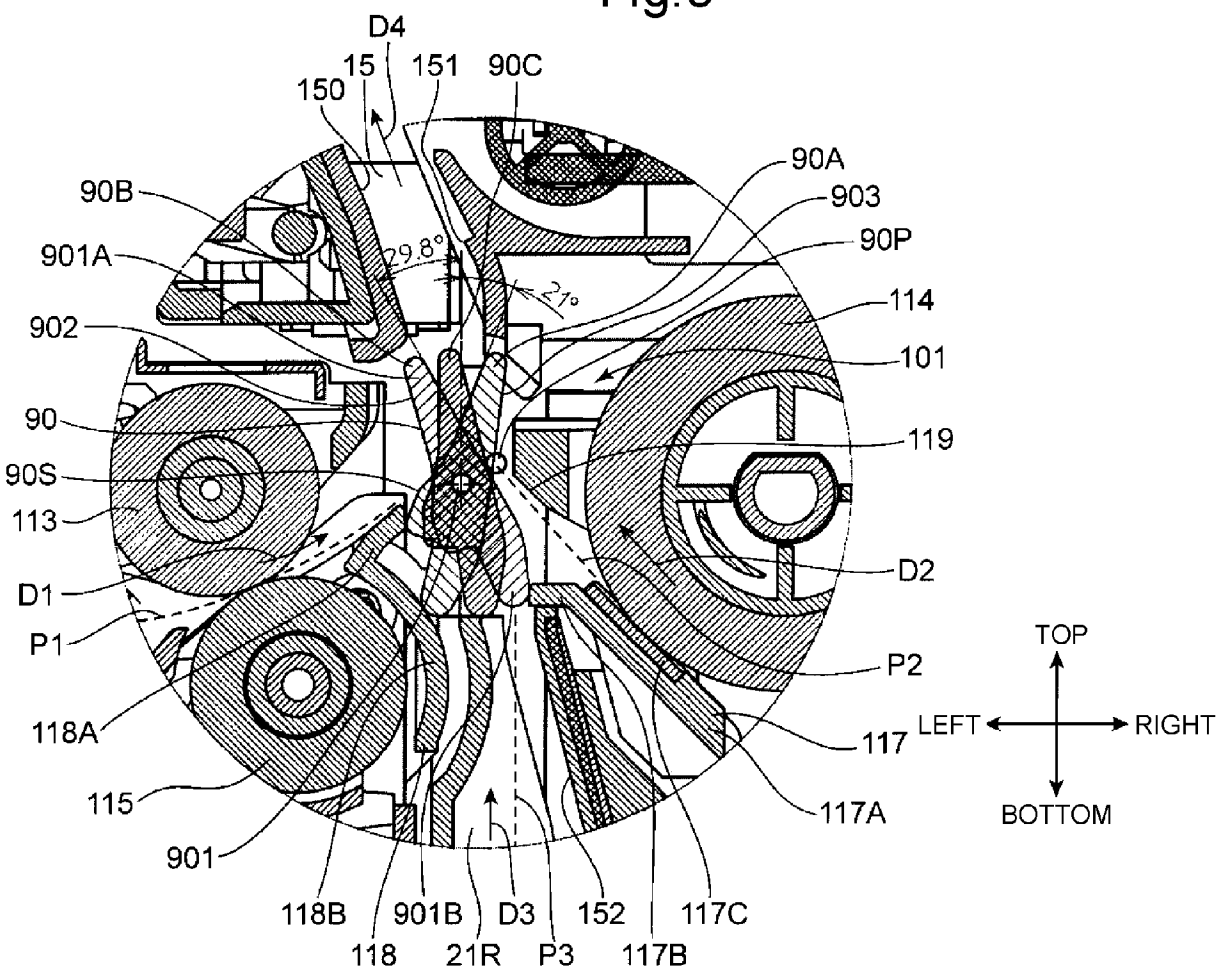
FIG. 5 is an enlarged cross-sectional view of a conveyance junction section of the image forming apparatus according to the embodiment of the present disclosure.

Next, the conveyance junction section 101 according to this embodiment will be described with reference to FIGS. 4 and 5. FIG. 4 is an enlarged cross-sectional view of a part of the image forming apparatus 1 including the paper feed device 10, and FIG. 5 is a further enlarged cross-sectional view of a periphery of the conveyance junction section 101 in FIG. 4. In this embodiment, three sheet conveying paths (a first sheet conveying path P1, a second sheet conveying path P2, and a third sheet conveying path P3) are joined in the conveyance junction section 101.

The first sheet conveying path P1 (a first conveying path) is a conveying path configured to convey the sheet S1 (the first sheet) fed from the cassette 110. The sheet S1 is conveyed to the right and slightly upward on the first sheet conveying path P1. As described above, the sheet S1 passes through the paper feed nip formed between the first paper feed roller 113 and the counter roller 115, and enters the conveyance junction section 101 (an arrow line D1 in FIG. 5). In addition, a cover member 118 is disposed downstream in the sheet conveying direction from the counter roller 115. The cover member 118 includes a guide part 118A and a protective part 118B. The guide part 118A is disposed at an upper end part of the cover member 118 to define a part of the first sheet conveying path P1. That is, the guide part 118A extends in the conveying direction of the sheet S1 on the first sheet conveying path P1. The protective part 118B extends from the guide part 118A, and is disposed along a peripheral surface of the counter roller 115 at intervals with the peripheral surface thereof. The protective part 118B protects the peripheral surface of the counter roller 115 from scratches or foreign matters when the conveyance junction section 101 is exposed to the outside of the image forming apparatus 1 in order to perform the task of removing a clogged sheet in the conveyance junction section 101, as will be described later.

The second sheet conveying path P2 (a second conveying path) is a conveying path configured to convey the sheet S2 (the second sheet) fed from the manual feed tray 240. The sheet S2 is conveyed to the left and upward on the second sheet conveying path P2. In addition, the second sheet conveying path P2 is joined with the first sheet conveying path P1 in the conveyance junction section 101. A counter pad 117 is disposed below the above-described second paper feed roller 114.

The counter pad 117 is a member configured to form a paper feed nip between the counter pad and the second paper feed roller 114. The counter pad 117 is disposed to face the second paper feed roller 114 to the left of and below the second paper feed roller 114. The counter pad 117 includes a pad base part 117A, a pad front end part 117B, and a pad frictional part 117C. The pad base part 117A is a main body part of the counter pad 117, and a plate-shaped member disposed to face the second paper feed roller 114. The pad front end part 117B extends to the left from an upper end part of the pad base part 117A. The pad frictional part 117C is fixed to an upper surface portion of the pad base part 117A. The pad frictional part 117C abuts a peripheral surface of the second paper feed roller 114 to form a paper feed nip between the pad fictional part and the peripheral surface of the second paper feed roller 114. In order to suitably separate the sheet S2 loaded in the manual feed tray 240, the pad frictional part 117C is made of a material with a high frictional coefficient. As the second paper feed roller 114 rotates, the sheet S2 passes between the second paper feed roller 114 and the pad frictional part 117C, and enters the conveyance junction section 101 (an arrow line D2 in FIG. 5).

Further, the third sheet conveying path P3 (a third conveying path) is a conveying path disposed upward from the bottom between the first sheet conveying path P1 and the second sheet conveying path P2. The third sheet conveying path P3 is a conveying path that reaches the conveyance junction section 101 through a connection opening section 21R illustrated in FIG. 4. When a post-attachment type paper feed cassette (not illustrated) is mounted on the image forming apparatus 1 illustrated in FIG. 1 or 2, a sheet S3 (a third sheet) fed from the paper feed cassette enters the connection opening section 21R, and is conveyed on the third sheet conveying path P3 (an arrow line D3 in FIG. 5).

A guide member 90 is disposed in the above-described conveyance junction portion (in other words, the conveyance junction section 101) of the three sheet conveying paths. The sheet S conveyed from any sheet conveying path is guided by the guide member 90 to enter a joining conveyance path 15 (FIG. 5) (a fourth conveying path). In other words, the guide member 90 guides the sheet S conveyed on the first sheet conveying path P1, the second sheet conveying path P2, and the third sheet conveying path P3 upward. The joining conveyance path 15 is defined by a first wall part 150 on the left side, and a second wall part 151 on the right side. In addition, the sheet S conveyed into the joining conveyance path 15 reaches the above-described pair of registration rollers 116, and then enters the image forming section 120.

Referring to FIG. 5, the guide member 90 is formed in an elongated shape as seen from a cross-section orthogonal to the conveying direction of the sheet S, and is a plate shape member that extends in a front-to-back direction (a direction orthogonal to the paper surface in FIG. 5). The guide member 90 includes a supporting point portion 901, a guide part 901A, and an abutting part 901B.

The supporting point portion 901 is disposed at a central part of the guide member 90 in a lengthwise direction as seen from the cross-section. The supporting point portion 901 serves as a supporting point during the pivoting of the guide member 90. In addition, the guide member 90 is pivoted around the supporting point portion 901 as the supporting point, and can shift between a first position 90A and a second position 90B in FIG. 5. That is, in the first position 90A, an upper end part of the guide member 90 is disposed rightmost. In addition, in the second position 90B, the upper end part of the guide member 90 is disposed leftmost. Further, during the pivoting of the guide member 90, a position at which the guide member 90 extends in a substantially vertical direction between the first position 90A and the second position 90B is defined as a third position 90C.

The guide part 901A is a portion extending upward from the supporting point portion 901 of the guide member 90. The guide part 901A has a shape that slightly tapers toward an upper end thereof. The guide part 901A includes a left guide surface 902 and a right guide surface 903 which are a pair of side surfaces. The left guide surface 902 is a left side surface of the guide part 901A, and the right guide surface 903 is a right side surface of the guide part 901A.

The abutting part 901B (a protruding part) is a portion extending downward (upstream in a third direction) from the supporting point portion 901 of the guide member 90. In addition, the abutting part 901B includes a region with an outwardly protruding shape adjacent to the supporting point portion 901 thereof on the left side portion. In addition, in the above-described first position 90A of the guide member 90, a left guide surface upstream part 90S which is a wall surface of the protruding part is disposed along a guide part 118A of the cover member 118 to define a part of the first sheet conveying path P1. Further, during the pivoting of the guide member 90, when the abutting part 901B abuts the pad front end part 117B of the counter pad 117, the second position 90B of the guide member 90 is defined. In this case, the right side portion of the abutting part 901B defines a part of the second sheet conveying path P2. In addition, when the abutting part 901B (a lower end part of the left guide surface upstream part 90S) abuts the protective part 118B of the cover member 118, the first position 90A of the guide member 90 is defined.

Further, in this embodiment, the center of the guide member 90 is set so that the guide member 90 is disposed at the first position 90A by a self weight of the guide member 90. In addition, as another embodiment, it may be possible to set the supporting point portion 901 or the guide member 90 to have a helical spring (not illustrated) installed thereon, such that when no other external force is applied to the guide member 90, the guide member 90 is disposed at the first position 90A by a biasing force of the helical spring.

Further, a wall part 119 is disposed to face the guide member 90 on the right of the guide member 90. The wall part 119 is integrally fixed to a casing opening and closing section (an access cover member) 21A to be described later. The wall part 119 defines a downstream end part in the conveying direction of the second sheet conveying path P2 between the wall part and the guide member 90.

Next, the operation of the guide member 90 when the sheet enters the conveyance junction section 101 through each sheet conveying path will be described.

When the sheet S1 housed in the cassette 110 is conveyed into the first sheet conveying path P1, as described above, the guide member 90 is disposed at the first position 90A by the self weight of the guide member 90. Therefore, the sheet S1 passing between the first paper feed roller 113 and the counter roller 115 is guided upward by the left guide surface 902 of the guide member 90 in the first position 90A, while sliding on the guide part 118A and the left guide surface upstream part 90S. In addition, the sheet S1 is conveyed to the pair of registration rollers 116 from the joining conveyance path 15, while sliding on a second wall part 151. Further, in the image forming apparatus 1, the sheet S1 loaded in the cassette 110 is fed more frequently than the manual feed tray 240, and thereby the sheet S1 is stably conveyed by setting a position at which the guide member 90 is normally disposed as the first position 90A.

Meanwhile, the sheet S2 loaded in the manual feed tray 240 passes between the second paper feed roller 114 and the counter pad 117, and then is conveyed toward the guide member 90 disposed at the first position 90A by the self weight. In this case, in this embodiment, the angle of the counter pad 117 (the pad frictional part 117C) is set beforehand so that the front edge of the sheet S2 conveyed on the second sheet conveying path P2 abuts a contacting part 90P disposed at an upper portion of the supporting point portion 901 of the right guide surface 903 of the guide member 90. Therefore, when the front edge of the sheet S2 abuts the contacting part 90P, the guide member 90 is pivoted around the supporting point portion 901 to be disposed at the second position 90B. Thus, the sheet S2 is guided upward, while sliding on the right guide surface 903 of the guide member 90 in the second position 90B. Further, the sheet S2 is conveyed to the pair of registration rollers 116 from the joining conveyance path 15, while sliding on the first wall part 150.

Further, the sheet S3 fed from the post-attachment type paper feed cassette (not illustrated) is conveyed into the third sheet conveying path P3 through the connection opening section 21R (an arrow line D3 in FIG. 5). In this embodiment, as in the case of the second sheet conveying path P2, the angle of a third wall part 152 which is a right side wall part defining the third sheet conveying path P3 is set beforehand so that the front edge of the sheet S3 abuts the contacting part 90P of the guide member 90. In addition, when the front edge of the sheet S3 abuts the contacting part 90P, the guide member 90 is pivoted around the supporting point portion 901 to be disposed at the third position 90C. Thus, the sheet S3 is guided upward, while sliding on the right guide surface 903 of the guide member 90 in the third position 90C. Further, the sheet S3 is conveyed to the pair of registration rollers 116 from the joining conveyance path 15, while passing between the first wall part 150 and the second wall part 151.

As described above, according to this embodiment, the sheet S conveyed from the first sheet conveying path P1, the second sheet conveying path P2, and the third sheet conveying path P3 is stably guided to the joining conveyance path 15 by pivoting of the guide member 90. In this case, the supporting point for the pivoting of the guide member 90 is disposed at the central part of the guide member 90 in a lengthwise direction, thereby it is possible to pivot the guide member 90 with a large range of movement in as reduced a space as possible. In particular, in this embodiment, as illustrated in FIG. 5, an angle formed by the left guide surface 902 and the vertical direction in the first position 90A is 21 degrees. In addition, an angle formed by the right guide surface 903 and the vertical direction in the second position 90B is 29.8 degrees. In other words, an angle between two sheet conveying directions switched by the guide member 90 spans 50.8 degrees. Therefore, in the paper feed device 10 having the first sheet conveying path P1 reaching from the left to the conveyance junction section 101 and the second sheet conveying path P2 reaching from the right to the conveyance junction section 101, whichever conveying path the sheet S is conveyed from, it is possible to stably convey the sheet S upward with a reduced conveyance load to the sheet S. In addition, as in this embodiment, if the pivoting supporting point of the guide member 90 is not disposed at the central part thereof in the lengthwise direction, as described above, it is difficult to cover the range of movement of the guide member 90.

Figure 7:
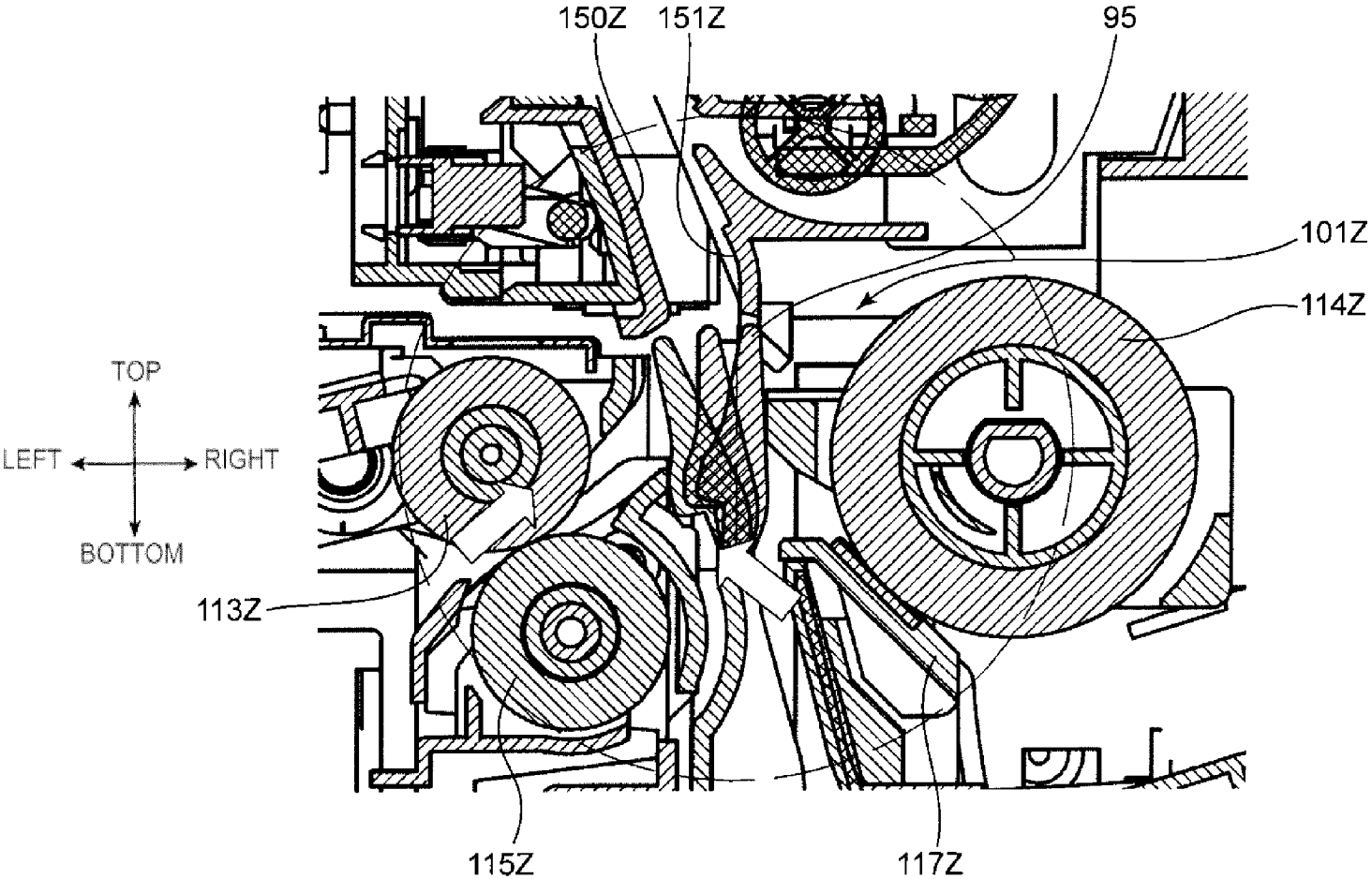
FIG. 7 is an enlarged cross-sectional view of a part of an image forming apparatus compared to the embodiment of the present disclosure.
Figure 8:
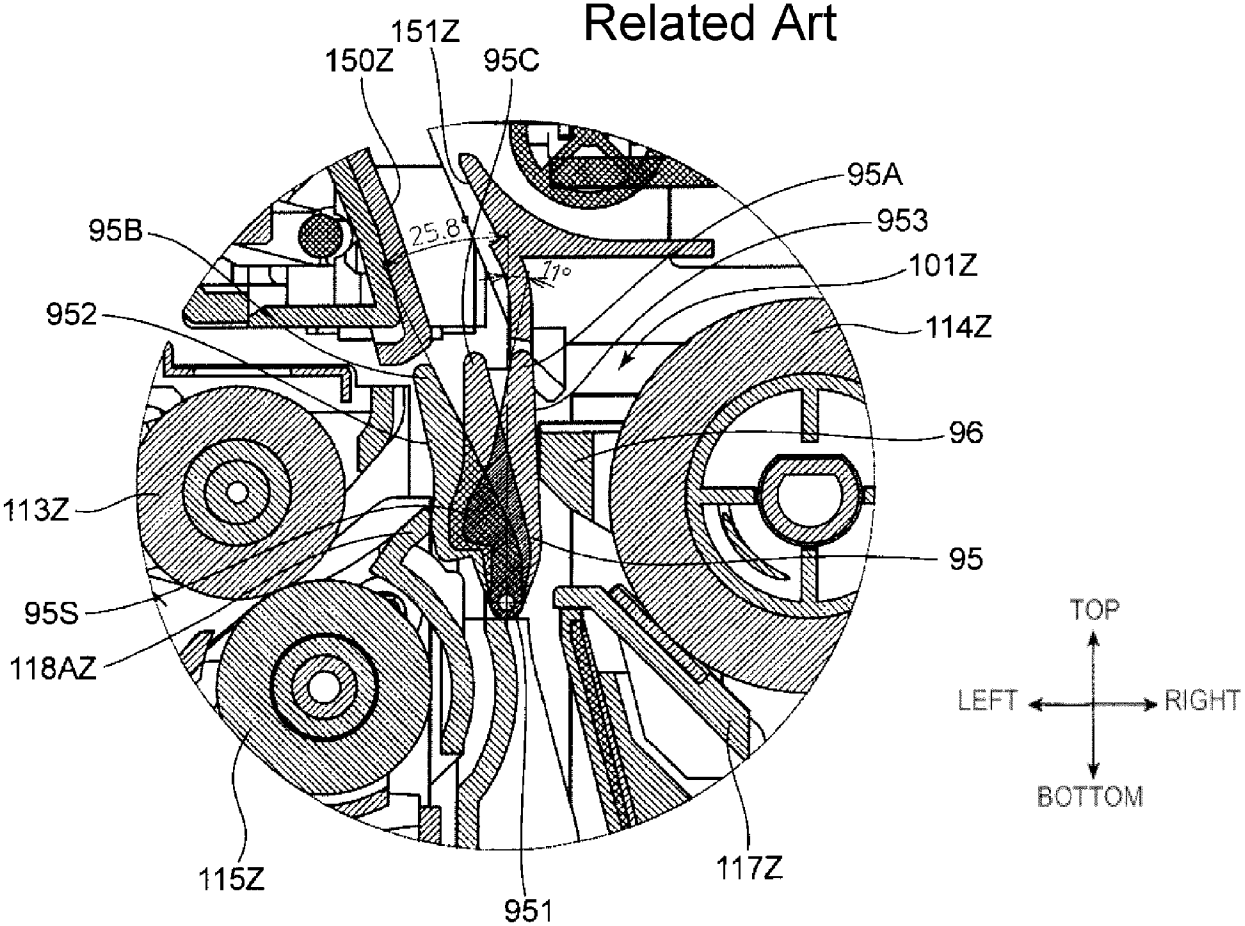
Fig.8 Related Art
FIG. 8 is an enlarged cross-sectional view of a part of a conveyance junction section of the image forming apparatus compared to the embodiment of the present disclosure.

FIG. 7 is an enlarged cross-sectional view of a part of an image forming apparatus 1Z referred to for comparison in this embodiment. FIG. 8 is an enlarged cross-sectional view of a part of a conveyance junction section 101Z of the image forming apparatus compared to this embodiment. Referring to FIG. 8, the conveyance junction section 101Z includes a swing guide 95 referred to in comparison with the guide member 90 of this embodiment. The swing guide 95 is swingable around a supporting point 951 disposed at a lower end part thereof. When the swing guide 95 is swung, and a right guide surface 953 which is a right side surface of the swing guide 95 abuts a protruding part 96 disposed inside of the image forming apparatus 1Z, the swing guide 95 is disposed rightmost (95A in FIG. 8). In this case, the swing guide 95 guides the sheet S passed between a first paper feed roller 113Z and a counter roller 115Z upward. In addition, a left guide surface 952 which is a left side surface of the swing guide 95 is disposed along the second wall part 151Z. On the other hand, when a left guide surface upstream part 95S of the swing guide 95 swings to abuts the guide part 118AZ, the swing guide 95 is disposed leftmost (95B in FIG. 8). In this case, the swing guide 95 guides the sheet S passed between a second paper feed roller 114Z and a counter pad 117Z upward. At this time, the right guide surface 953 of the swing guide 95 is disposed along the first wall part 150Z.

As described above, when the swing guide 95 is swung around the supporting point 951 disposed at the lower end part of the swing guide 95, because the supporting point 951 and the upper end part of the swing guide 95 are separate from each other, the range of movement of the swing guide 95 becomes narrow. In FIG. 8, an angle formed by the left guide surface 952 of a swing guide 95A positioned rightmost and the vertical direction is 11 degrees. In addition, an angle formed by the right guide surface 953 of a swing guide 95B positioned leftmost and the vertical direction is 25.8 degrees. In other words, the angle between the two sheet conveying directions switched by the swing guide 95 is 36.8 degrees. Further, in the case of FIG. 8, when the sheet S passing between the first paper feed roller 113Z and the counter roller 115Z is conveyed toward the swing guide 95A, a gap is formed between the left guide surface upstream part 95S of the swing guide 95 and the guide part 118AZ. On the other hand, in this embodiment, as illustrated in FIG. 5, in the first position 90A of the guide member 90, the left guide surface upstream part 90S is disposed so as to continue to the guide part 118A. Therefore, the sheet S is stably guided compared to the aspect illustrated in FIG. 8.

Figure 6:
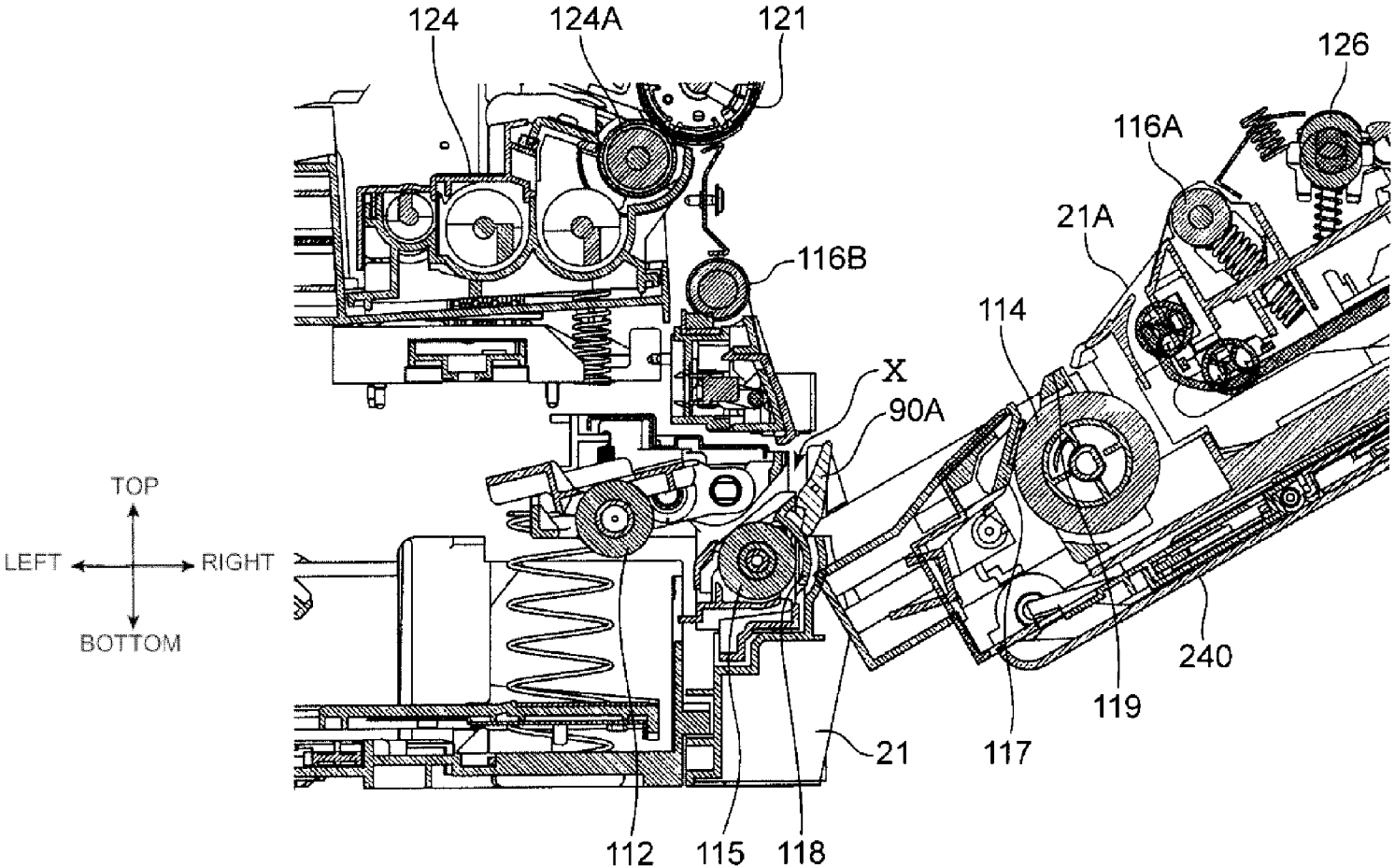
FIG. 6 is a cross-sectional view illustrating a state in which a casing opening and closing section is opened in the image forming apparatus according to the embodiment of the present disclosure.

Further, in this embodiment, even if a sheet S becomes clogged in the conveyance junction section 101, the sheet S is easily removed due to the position of the guide member 90. FIG. 6 is a cross-sectional view illustrating a state in which the casing opening and closing section 21A is opened in the image forming apparatus 1 according to the embodiment of the present disclosure. As illustrated in FIG. 6, the casing opening and closing section 21A which is a right side portion of the lower casing 21 of the image forming apparatus 1 is formed to pivot with the lower side as a supporting point. A part of the sheet conveying path PP is exposed to an outside of the lower casing 21 by the pivoting of the casing opening and closing section 21A. In particular, the conveyance junction section 101 is exposed by the pivoting of the casing opening and closing section 21A. Specifically, the above-described wall part 119 is separated from the guide member 90 by the pivoting of the casing opening and closing section 21A. Therefore, the downstream end part of the second sheet conveying path P2 is exposed to the outside of the lower casing 21. As a result, even if a sheet S2 becomes clogged in the second sheet conveying path P2, the sheet S2 is easily removed. Further, as described above, the guide member 90 is disposed at the first position 90A by the self weight of the guide member 90. As a result, in FIG. 6, a region X positioned to the left of the guide member 90 in the first position 90A, which is a part of the first sheet conveying path P1, is exposed to the outside. Therefore, even if the sheet S2 or S3 conveyed on the second sheet conveying path P2 and the third sheet conveying path P3 becomes clogged to the right of the guide member 90, or the sheet S1 conveyed on the first sheet conveying path P1 becomes clogged to the left of the guide member 90, these sheets S are easily removed.

According to the embodiment described above, in the first position 90A, the guide member 90 guides the sheet S1 conveyed on the first sheet conveying path P1 to the joining conveyance path 15. In addition, in the second position 90B, the guide member 90 guides the sheet S2 conveyed on the second sheet conveying path P2 to the joining conveyance path 15. The guide member 90 is pivoted around the supporting point portion 901 disposed at the central part thereof in the lengthwise direction. Therefore, as the guide member 90 switches the conveying path of the sheet S guided to the joining conveyance path 15 between the first sheet conveying path P1 and the second sheet conveying path P2, the range of the movement of the guide member 90 is mostly covered, compared to the case in which the supporting point is disposed at one end of the guide member 90 in the lengthwise direction.

That is, in this embodiment, the pivoting operation of the guide member 90 is conducted so as to significantly pivot around the supporting point portion 901 with a reduced space, as described above. Therefore, the operation in which the right guide surface 903 and the left guide surface 902 downstream in the sheet conveying direction from the supporting point portion 901 become a part of the joining conveyance path 15 by pivoting of the guide member 90 around the supporting point portion 901 for switching, and the abutting part 901B upstream in the sheet conveying direction from the supporting point portion 901 abuts the pad front end part 117B or the protective part 118B can be achieved with a reduced space. Thereby, it is possible to shape the guide member 90 which pivots for switching along the shape of the first sheet conveying path P1, the second sheet conveying path P2, and the third sheet conveying path P3 with a reduced space.

In addition, according to the embodiment described above, if the guide member 90 is pivoted around the supporting point portion 901, the abutting part 901B of the guide member 90 defines a part of the first sheet conveying path P1 and the second sheet conveying path P2. Therefore, the guide member 90 can suitably guide the sheet along the shape of the sheet conveying path with a switchable conveying direction.

Further, according to the embodiment described above, the guide member 90 is stably disposed at the first position 90A by the self weight or the biasing force of the biasing member provided in the supporting point portion 901. Therefore, the sheet S1 conveyed on the first sheet conveying path P1 can be correctly guided to the joining conveyance path 15. Further, when the front edge of the sheet S2 conveyed on the second sheet conveying path P2 abuts the guide member 90, the guide member 90 is shifted from the first position 90A to the second position 90B. Therefore, even if the guide member 90 is disposed at the first position 90A, the sheet S2 conveyed on the second sheet conveying path P2 can be correctly guided to the joining conveyance path 15.

Further, according to the embodiment described above, the front edge of the sheet S2 abuts the contacting part 90P downstream (on an upper side) in the second direction from the supporting point portion 901, and thereby the guide member 90 can be correctly shifted from the first position 90A to the second position 90B.

Further, according to the embodiment described above, in the open state of the casing opening and closing section 21A, the wall part 119 is separated from the guide member 90, and thereby a part of the second sheet conveying path P2 is opened to the outside of the lower casing 21. In addition, when the guide member 90 is disposed at the first position 90A, a part of the first sheet conveying path P1 is exposed to the outside of the lower casing 21. Therefore, in the area around the guide member 90, even if the sheet S becomes clogged in the first sheet conveying path P1 or the second sheet conveying path P2, the sheet S can be easily removed.

Further, according to the embodiment described above, the guide member 90 can guide the sheet S3 to the joining conveyance path 15 (upward), which is conveyed on the third sheet conveying path P3, in addition to the first sheet conveying path P1 and the second sheet conveying path P2.

Although the paper feed device 10 according to the embodiment of the present disclosure and the image forming apparatus 1 were described above, the present disclosure is not limited thereto, and can take a modified embodiment as follows for example.

(1) In the embodiment described above, it was described that three conveying paths of the first sheet conveying path P1, the second sheet conveying path P2, and the third sheet conveying path P3 are joined in the conveyance junction section 101, but the present disclosure is not limited thereto. The conveyance junction section 101 may be any one in which a plurality of conveying paths are joined. Further, none of the first sheet conveying path P1, the second sheet conveying path P2 and the third sheet conveying path P3 is limited to extending from the cassette 110, the manual feed tray 240, and the post-attachment type paper feed cassette (not illustrated), but may be any one in which the sheet is conveyed toward the conveyance junction section 101.

(2) Further, in the embodiment described above, it was described that the guide member 90 is disposed at the first position 90A by the self weight, but the present disclosure is not limited thereto. The guide member 90 may be disposed at the first position 90A as a standby position by the biasing force of the helical spring, or the like, and further may be disposed at the second position 90B or the third position 90C as a standby position.

Figure 9:
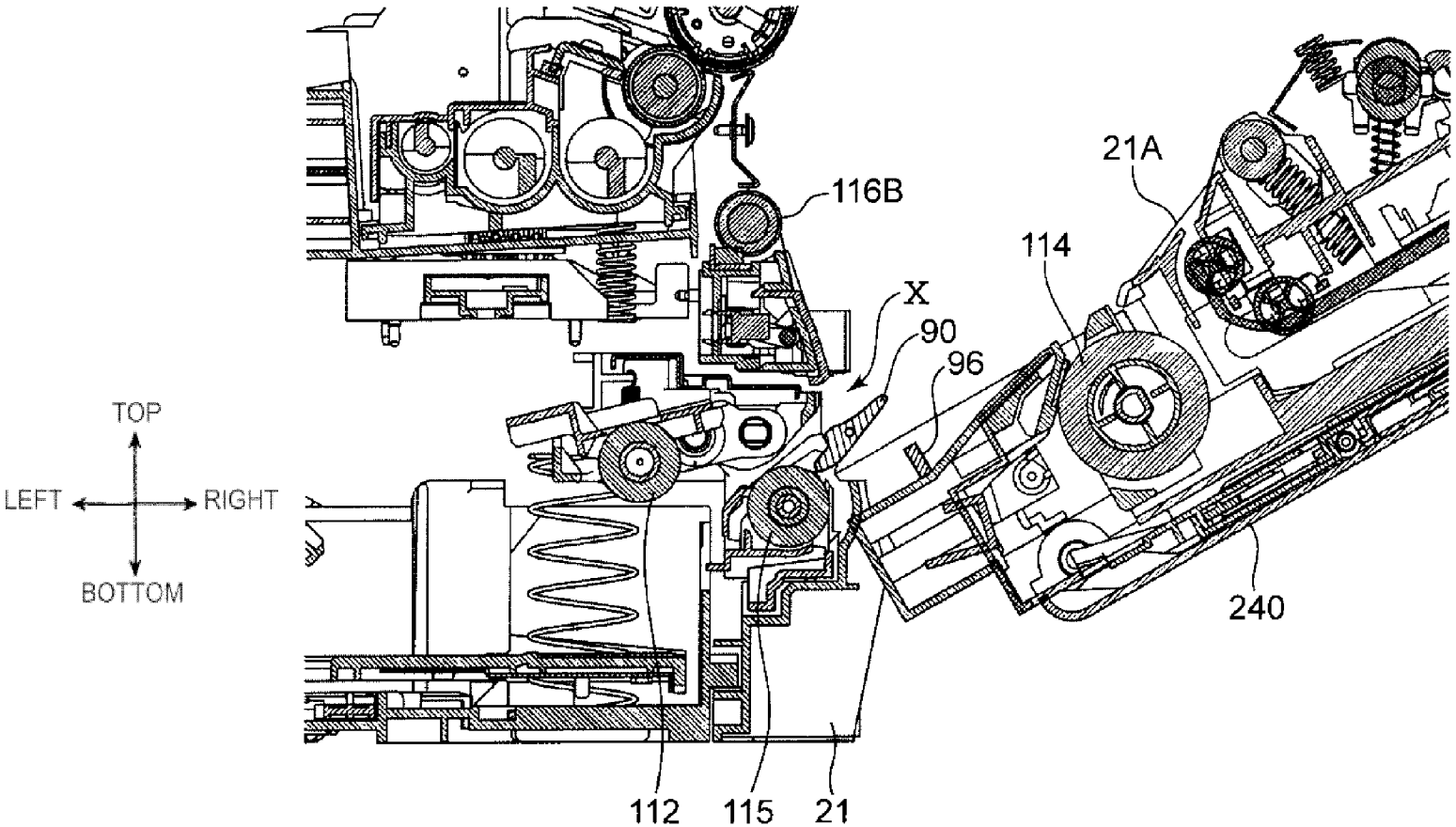
FIG. 9 is a cross-sectional view illustrating a state in which a casing opening and closing section is opened in an image forming apparatus according to other embodiment of the present disclosure.

(3) Further, in the embodiment described above, it was described the guide member 90 is stopped in the first position 90A when the casing opening and closing section 21A is open in FIG. 6, but the present disclosure is not limited thereto. FIG. 9 is a cross-sectional view of the image forming apparatus 1 when the casing opening and closing section 21A is opened in the modified embodiment of the present disclosure. In this modified embodiment, the image forming apparatus 1 is not provided with the cover member 118 of FIG. 6. In addition, the guide member 90 is pivoted to the right from the first position 90A by the self weight, as the casing opening and closing section 21A is opened (a retreat position). Therefore, a region X on the left side of the guide member 90 is opened further, thereby improving the removability of the sheet S. Further, a protruding part 96 is disposed to face the guide member 90 on the lower end of the casing opening and closing section 21A. A pair of protruding parts 96 are disposed at opposite end parts of the guide member 90 in the front-to-back direction. When the casing opening and closing section 21A is closed, the protruding part 96 abuts the upper end part of the guide member 90. As a result, the guide member 90 is shifted from the retreat position to the first position 90A. Meanwhile, with the casing opening and closing section 21A closed, the shapes of the center and the protruding part of the guide member 90 are set beforehand so that the guide member 90 abuts the protruding part 96 by the self weight so as to be disposed at the first position 90A.

Various modified embodiments and alterations of this disclosure will be apparent to those skilled in the art without departing from the scope and spirit of this disclosure, and it should be understood that this disclosure is not limited to the illustrative embodiments set forth herein.

What is claimed is:

1. A sheet conveying apparatus comprising:

a casing;

a first conveying disposed in the casing to convey a first sheet;

a second conveying path which is disposed in the casing to convey a second sheet;

a junction portion in which the first conveying path and the second conveying path are joined;

a joining conveyance path which is connected to the junction portion, and extends downstream in a sheet conveying direction on the first conveying path and the second conveying path; and a guide member which is disposed in the junction portion and configured to shift a position between a first position to guide the first sheet from the first conveying path to the joining conveyance path and a second position to guide the second sheet from the second conveying path to the joining conveyance path, wherein the guide member is formed in an elongated shape as seen from a cross-section orthogonal to a conveying direction of the sheet, and has a supporting point portion disposed at a central part or a vicinity thereof in a lengthwise direction of the elongated shape so as to shift the position by pivoting around the supporting point portion, and one side portion of upstream side portions of the guide member which is upstream in the sheet conveying direction from the supporting point portion forms a part of the first conveying path when the guide member is disposed at the first position, and another side portion of the upstream side portions forms a part of the second conveying path when the guide member is disposed at the second position.

2. The sheet conveying apparatus according to claim 1, wherein one side portion of downstream side portions of the guide member which is downstream in the sheet conveying direction from the supporting point portion forms a part of the joining conveyance path when the guide member is disposed at the first position, and another side portion of the downstream side portions forms a part of the joining conveyance path when the guide member is disposed at the second position.

3. The sheet conveying apparatus according to claim 1, wherein the guide member is disposed at the first position by a self weight or a biasing force of a biasing member provided on the guide member, and the guide member is pivoted by abutting a front edge of the second sheet conveyed on the second conveying path to shift from the first position to the second position.

4. The sheet conveying apparatus according to claim 3, wherein, when the guide member is disposed at the first position, the front edge of the second sheet conveyed on the second conveying path abuts the side portion of the guide member which is downstream in the sheet conveying direction from the supporting point portion.

5. The sheet conveying apparatus according to claim 1, further comprising:

a sheet loading section configured to load the first sheet; and a manual feed tray configured to load the second sheet, wherein the first conveying path is a conveying path configured to convey the first sheet from the sheet loading section to the junction portion, and the second conveying path is a conveying path configured to convey the second sheet from the manual feed tray to the junction portion.

6. An image forming apparatus comprising:

the sheet conveying apparatus according to claim 1;

an image forming section configured to form an image on the first sheet and the second sheet; and a fourth conveying path configured to convey the first sheet or the second sheet guided to the joining conveyance path by the guide member to the image forming section.

7. A sheet conveying apparatus comprising:

a casing;

a first conveying path disposed in the casing to convey a first sheet;

a second conveying path which is disposed in the casing to convey a second sheet;

a junction portion in which the first conveying path and the second conveying path are joined;

a joining conveyance path which is connected to the junction portion, and extends downstream in a sheet conveying direction on the first conveying path and the second conveying path; and a guide member which is disposed in the junction portion and configured to shift a position between a first position to guide the first sheet from the first conveying path to the joining conveyance path and a second position to guide the second sheet from the second conveying path to the joining conveyance path, wherein the guide member is formed in an elongated shape as seen from a cross-section orthogonal to a conveying direction of the sheet, and has a supporting point portion disposed at a central s art or a vicinity thereof in a lengthwise direction of the elongated shape so as to shift the position by pivoting around the supporting point portion, and the sheet conveying apparatus further comprising an access cover member which is disposed to face the guide member, has a wall part configured to form a part of the second conveying path between the wall part and the guide member, and is configured to be opened and closed to the casing, wherein, in an open state of the access cover member, the guide member is disposed at the first position, and the junction portion is exposed to an outside of the casing.

8. The sheet conveying apparatus according to claim 7, wherein the guide member is pivoted to a retreat position at which the first conveying path is exposed to the outside of the casing from the first position, as the access cover member is changed from the closed state to the open state, and further the access cover member including a protruding part which is disposed thereon, and abuts the guide member according to a change of the cover member from the open state to the closed state, so as to pivot the guide member from the retreat position to the first position.

9. A sheet conveying apparatus comprising:

a casing;

a first conveying path disposed in the casing to convey a first sheet;

a second conveying path which is disposed in the casing to convey a second sheet;

a junction portion in which the first conveying path and the second conveying path are joined;

a joining conveyance path which is connected to the junction portion, and extends downstream in a sheet conveying direction on the first conveying path and the second conveying path; and a guide member which is disposed in the unction portion and configured to shift a position between a first position to guide the first sheet from the first conveying path to the joining conveyance path and a second position to guide the second sheet from the second conveying path to the joining conveyance path;

wherein the guide member is formed in an elongated shape as seen from a cross-section orthogonal to a conveying direction of the sheet, and has a supporting point portion disposed at a central part or a vicinity thereof in a lengthwise direction of the elongated shape so as to shift the position by pivoting around the supporting point portion, and the sheet conveying apparatus further comprising a third conveying path which is disposed in the casing and connected to the junction portion from an another direction unlike the direction of the first conveying path and the second conveying path;

wherein the guide member configured to shift a third position to guide the sheet conveyed from the third conveying path to the junction portion in addition to the first position and the second position.

* * * * *